US010792789B1

(12) United States Patent
Dewey

(10) Patent No.: US 10,792,789 B1
(45) Date of Patent: Oct. 6, 2020

(54) MAGNETIC VISE BASE APPARATUS

(71) Applicant: Monte Dewey, Loveland, CO (US)

(72) Inventor: Monte Dewey, Loveland, CO (US)

( * ) Notice: Subject to any disclaimer, the term of this patent is extended or adjusted under 35 U.S.C. 154(b) by 0 days.

(21) Appl. No.: 16/393,167

(22) Filed: Apr. 24, 2019

(51) Int. Cl.
*B25B 1/24* (2006.01)
*B25B 11/00* (2006.01)

(52) U.S. Cl.
CPC ..... *B25B 1/2484* (2013.01); *B25B 11/002* (2013.01)

(58) Field of Classification Search
CPC ..... B25B 1/2484; B25B 11/002
USPC ..... 248/637, 683, 537, 206.5, 309.4; 269/8, 269/276
See application file for complete search history.

(56) References Cited

U.S. PATENT DOCUMENTS 2,197,850 A 4/1940 Bush
2,381,458 A 8/1945 Meister
2,993,395 A * 7/1961 Bohn ..... B23Q 1/28 269/75
3,428,305 A * 2/1969 Bohn ..... B25B 1/22 269/75
4,777,463 A 10/1988 Cory
5,338,016 A 8/1994 Howard
6,361,034 B1 * 3/2002 Wolfe ..... B25B 1/2463 269/247
6,640,666 B2 11/2003 Pliley
7,300,043 B1 * 11/2007 Lindsay ..... B25B 1/22 269/75
7,319,375 B2 1/2008 Roy
2005/0173853 A1 8/2005 Maes
2012/0013060 A1 1/2012 Chiang
2013/0222090 A1 * 8/2013 Haritou ..... F16G 11/00 335/285
2018/0297175 A1 * 10/2018 Mack ..... B25B 1/2484

FOREIGN PATENT DOCUMENTS

WO WO-2013024498 A1 * 2/2013 ..... B25B 1/125

* cited by examiner

*Primary Examiner* — Muhammad Ijaz

(57) ABSTRACT

A magnetic vise base apparatus for quickly installing a vise on any ferrous surface includes a base having a top platform and a pair of side walls perpendicularly coupled to the top platform. The top platform is configured to receive a vise. A magnet housing is coupled to the base between the pair of side walls. A magnet is coupled to the magnet housing and comprises a pair of ferrous blocks, a non-ferrous median, and a magnetic core. The magnet has a core aperture extending from a front side to a rear side of the magnet housing, fully through the non-ferrous median and partially into each of the pair of ferrous blocks to receive the magnetic core. The magnetic core is rotatable to magnetize and demagnetize the pair of ferrous blocks. A handle is coupled to a magnet rod coupled to rotate the magnetic core.

13 Claims, 5 Drawing Sheets

MAGNETIC VISE BASE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to vise bases and more particularly pertains to a new vise base for quickly installing a vise on any ferrous surface.

BRIEF SUMMARY OF THE INVENTION

An embodiment of the disclosure meets the needs presented above by generally comprising a base having a top platform and a pair of side walls perpendicularly coupled to an underside of the top platform. The top platform has a pair of threaded mounting holes extending from a topside through the underside proximal a front edge and a rear edge. The mounting holes is configured to receive a pair of fasteners to fix a vise to the top platform. A magnet housing is coupled to the base and has a front side separated from a rear side, a top side separated from an open bottom side, and a right side separated from a left side forming an inner cavity. The left side and the right side are coupled to an inner face of the pair of side walls and extend from proximal the front edge to proximal the rear edge of the top platform. A magnet is coupled to the magnet housing and comprises a pair of ferrous blocks, a non-ferrous median, and a magnetic core. The pair of ferrous blocks is coupled to the left side and the right side and extends from the front side to the rear side and from the top side to the open bottom side within the inner cavity. The non-ferrous median is coupled to the pair of ferrous blocks and extends from the front side to the rear side and from the top side to proximal the open bottom side within the inner cavity between the pair of ferrous blocks.

The magnet has a core aperture extending from the front side to the rear side fully through the non-ferrous median and partially into each of the pair of ferrous blocks. The magnetic core is coupled within the core aperture and extends from the front side to the rear side. The magnetic core has a positive hemisphere and a negative hemisphere and is rotatable such that a north pole of the positive hemisphere and a south pole of the negative hemisphere can be horizontally oriented within the pair of ferrous blocks in an engaged position or alternatively vertically oriented within the non-ferrous median in an alternate disengaged position. The magnetic core thus magnetizes the pair of ferrous blocks in the engaged position and alternatively demagnetizes the pair of ferrous blocks in the alternate disengaged position. A magnet rod is coupled to the magnetic core and extends through a rod aperture of the front side of the magnet housing. A handle is coupled to the magnet rod and is used to rotate the magnet rod and thus the magnetic core from the engaged position to the alternate disengaged position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
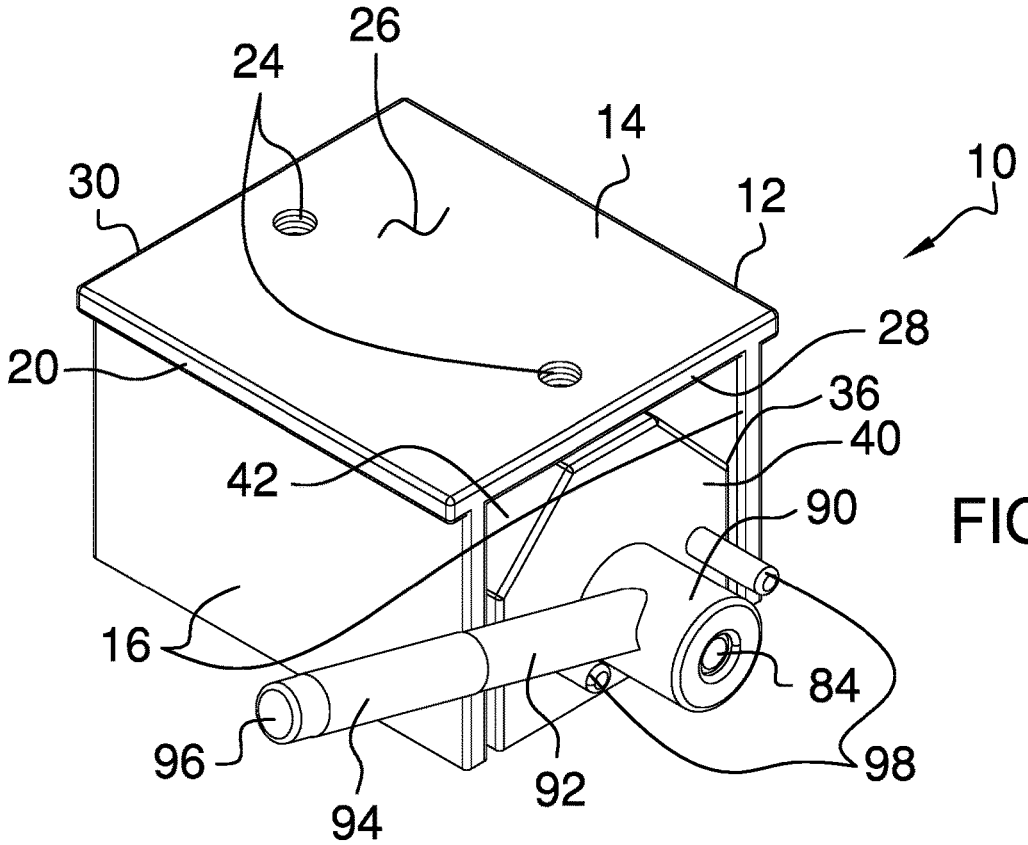
FIG. 1 is an isometric view of a magnetic vise base apparatus according to an embodiment of the disclosure.
Figure 2:
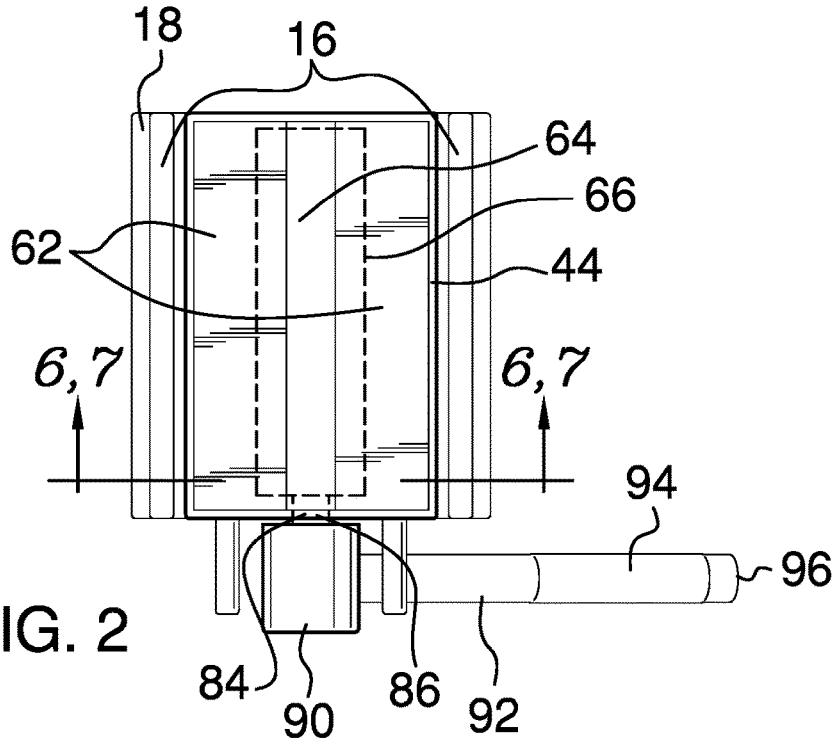
FIG. 2 is a bottom plan view of an embodiment of the disclosure.
Figure 3:
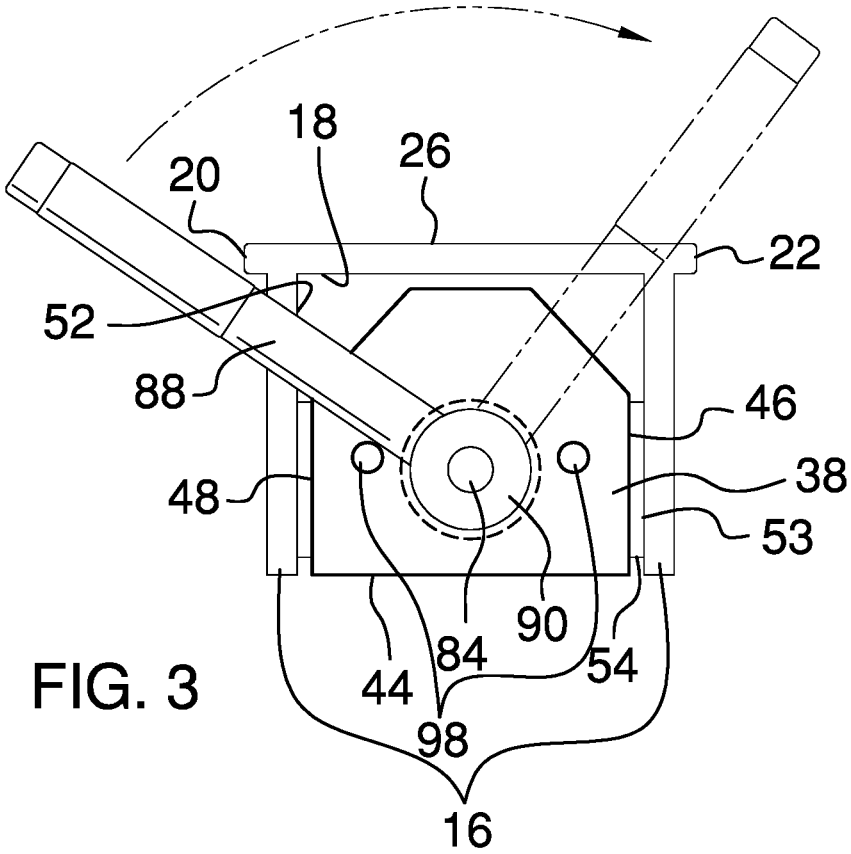
FIG. 3 is a front elevation view of an embodiment of the disclosure.
Figure 4:
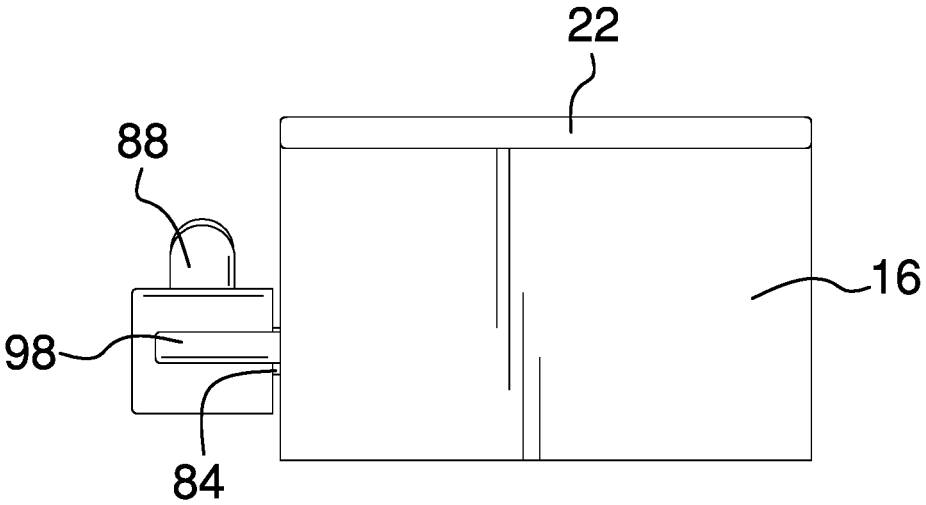
FIG. 4 is a side elevation view of an embodiment of the disclosure.
Figure 5:
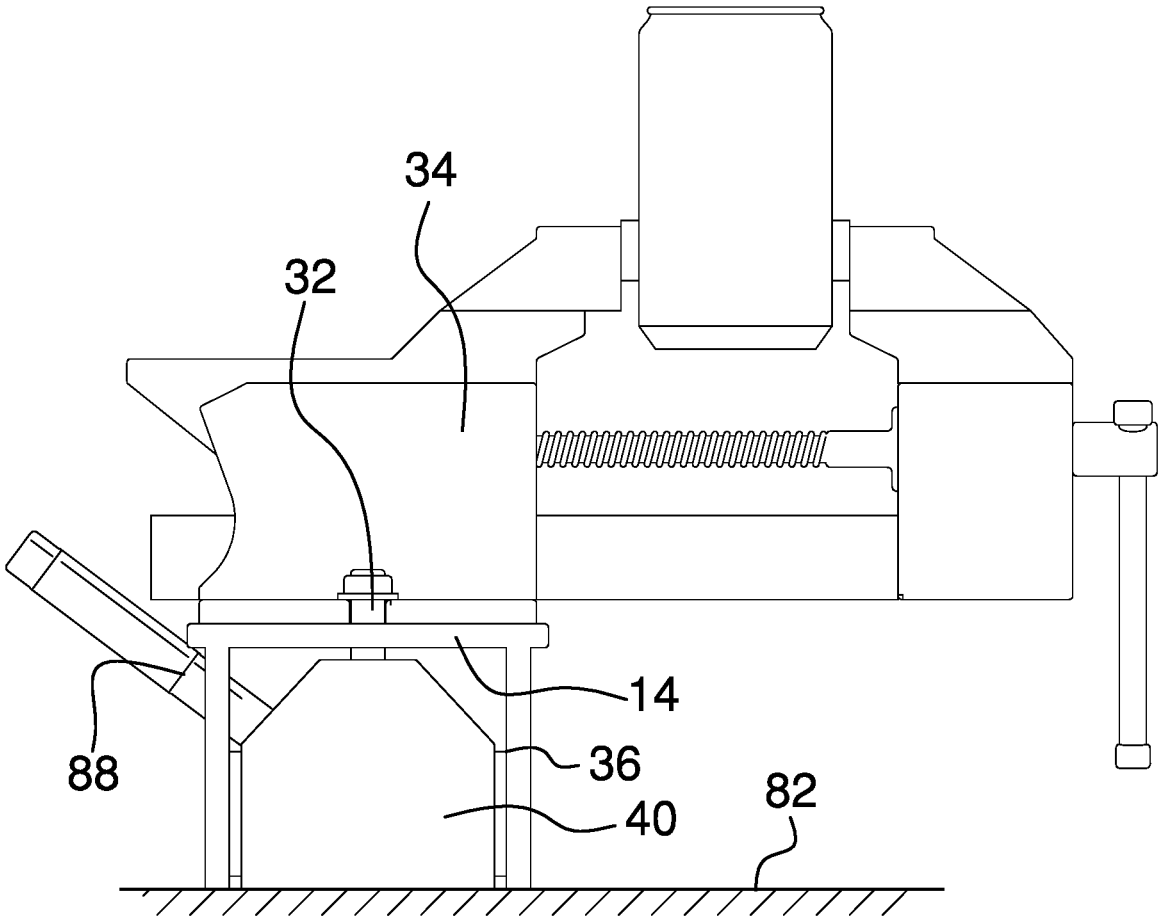
FIG. 5 is an in-use view of an embodiment of the disclosure.

With reference now to the drawings, and in particular to FIGS. 1 through 7 thereof, a new vise base embodying the principles and concepts of an embodiment of the disclosure and generally designated by the reference numeral 10 will be described.

As best illustrated in FIGS. 1 through 7, the magnetic vise base apparatus 10 generally comprises a base 12 having a top platform 14 and a pair of side walls 16 perpendicularly coupled to an underside 18 of the top platform. A left edge 20 and a right edge 22 of the top platform 14 may extend past the pair of side walls 16 to provide more mounting space without significantly increasing the overall size and weight of the apparatus 10. The top platform has a pair of threaded mounting holes 24 extending from a topside 26 through the underside 18 proximal a front edge 28 and a rear edge 30. The mounting holes 24 are configured to receive a pair of fasteners 32 to fix a vise 34 to the top platform 14.

A magnet housing 36 is coupled to the base 12 and has a front side 38 separated from a rear side 40, a top side 42 separated from an open bottom side 44, and a right side 46 separated from a left side 48 forming an inner cavity 50. The left side 48 and the right side 46 are coupled to an inner face 52 of the pair of side walls and extend from proximal the front edge 28 to proximal the rear edge 30 of the top platform. Each of the left side 48 and the right side 46 have an outer bridge portion 53 coupled to the pair of side walls 16. The outer bridge portion 53 has a height less than an overall height of the right side 46 and the left side 48. The outer bridge portions 53 form a pair of wall channels 54 along a bottom edge of the pair of side walls 16. The top side 42 is pitched and has a flat central section 56 and a pair of angled side sections 58. The flat central section 55 is parallel to, and spaced from, the underside 18 of the top platform and is configured to give clearance for the pair of fasteners 32. The front side 38 and the rear side 40 are thus hexagonal.

Figure 6:
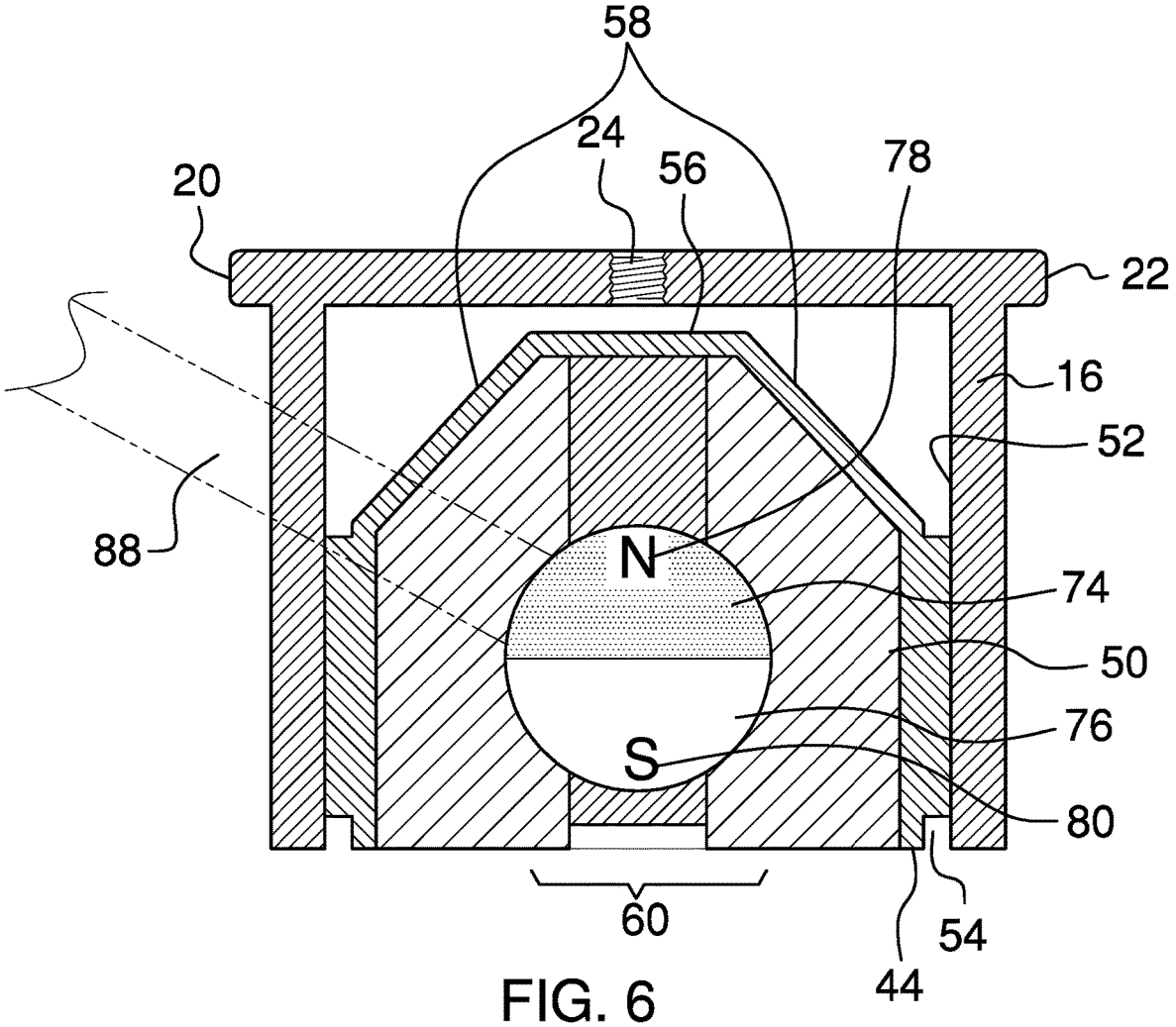
FIG. 6 is a cross-sectional view of an embodiment of the disclosure along line 6,7-6,7 of FIG. 2.
Figure 7:
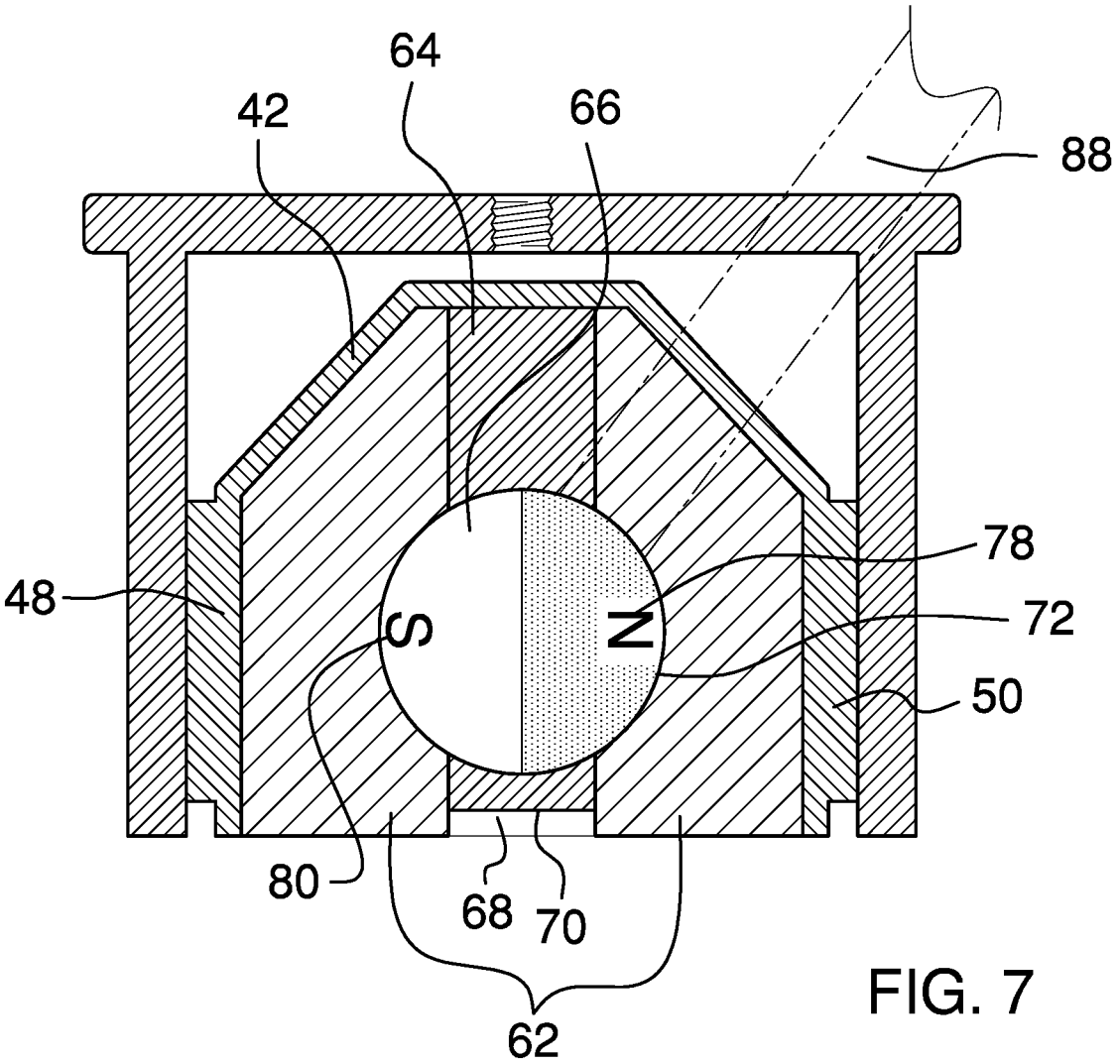
FIG. 7 is a cross-sectional view of an embodiment of the disclosure along line 6,7-6,7 of FIG. 2.

A magnet 60 is coupled to the magnet housing 36 and comprises a pair of ferrous blocks 62, a non-ferrous median 64, and a magnetic core 66. The pair of ferrous blocks 62 is coupled to the left side 48 and the right side 46 and extends from the front side 38 to the rear side 40 and from the top side 42 to the open bottom side 44 within the inner cavity 50. The non-ferrous median 64 extends from the front side 38 to the rear side 40 and from the top side 42 to proximal the open bottom side 44 within the inner cavity 50 between the pair of ferrous blocks 62. A width of the non-ferrous median 64 is less than 30% of a width of the inner cavity 50 between the left side 48 and the right side 46. The magnet 60 has a lower channel 68 defined along a bottom face 70 of the non-ferrous median 64 between the pair of ferrous blocks 62. The lower channel 68 may accommodate a break in a surface. The magnet 60 has a core aperture 72 extending from the front side 38 to the rear side 40 fully through the non-ferrous median 64 and partially into each of the pair of ferrous blocks 62. A profile of the core aperture 72 has two arcs passing through the non-ferrous median 64 each between 50° and 70° and two arcs passing through the pair of ferrous blocks 62 each between 110° and 130°. The magnetic core 66 is rotatably coupled within the core aperture 72 and extends from the front side 38 to the rear side 40. The magnetic core 66 has a positive hemisphere 74 and a negative hemisphere 76 and is rotatable such that a north pole 78 of the positive hemisphere 74 and a south pole 80 of the negative hemisphere 76 can be horizontally oriented within the pair of ferrous blocks 62 in an engaged position (as shown in FIG. 7) or alternatively vertically oriented within the non-ferrous median 64 in an alternate disengaged position (as shown in FIG. 6). The magnetic core 66 thus magnetizes the pair of ferrous blocks 62 in the engaged position and alternatively demagnetizes the pair of ferrous blocks 62 in the alternate disengaged position to fix the apparatus 10 to, and alternatively release the apparatus 10 from, a ferrous surface 82.

A magnet rod 84 is coupled to the magnetic core 66 and extends through a rod aperture 86 of the front side of the magnet housing. A handle 88 is coupled to the magnet rod 84 and is used to rotate the magnet rod 84 and thus the magnetic core 66 from the engaged position to the alternate disengaged position. The handle 88 has a cylindrical hub 90 coupled around the magnet rod 84 and a handle arm 92 perpendicularly extending from the hub 90. The handle 88 has a grip 94 coupled to the handle arm 92 proximal a distal end 96 thereof. A pair of stop rods 98 is perpendicularly coupled to the front side 38 of the magnet housing to limit the range of motion of the handle arm 92. The pair of stop rods 98 may be separated by 90° relative a central axis of the magnet core 66 and the magnet rod 84 to stop the handle 88 when the magnet core 66 is in the engaged and disengaged positions. The pair of stop rods 98 have a length less than a length of the hub 90.

In use, apparatus 10 is placed on a ferrous surface 82 and the handle 88 is rotated to move the magnet core 66 to the engaged position. The vise 34 is then fixed to the top platform 14 with the fasteners 32 and the pair of mounting holes 24. When desired, the handle 88 is rotated to move the magnet core 66 back to the disengaged position to reposition the apparatus 10 and the vise 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A magnetic vise base apparatus comprising:

a base, the base having a top platform and a pair of side walls perpendicularly coupled to an underside of the top platform, the top platform having a pair of threaded mounting holes extending from a topside through the underside proximal a front edge and a rear edge, the mounting holes being configured to receive a pair of fasteners to fix a vise to the top platform;

a magnet housing coupled to the base, the magnet housing having a front side separated from a rear side, a top side separated from an open bottom side, and a right side separated from a left side forming an inner cavity, the left side and the right side being coupled to an inner face of the pair of side walls and extending from proximal the front edge to proximal the rear edge of the top platform;

a magnet coupled to the magnet housing, the magnet comprising:

a pair of ferrous blocks, the pair of ferrous blocks coupled to the left side and the right side and extending from the front side to the rear side and from the top side to the open bottom side within the inner cavity;

a non-ferrous median coupled to the pair of ferrous blocks, the non-ferrous median extending from the front side to the rear side and from the top side to proximal the open bottom side within the inner cavity between the pair of ferrous blocks;

the magnet having a core aperture extending from the front side to the rear side fully through the non-ferrous median and partially into each of the pair of ferrous blocks;

a magnetic core coupled within the core aperture, the magnetic core extending from the front side to the rear side, the magnetic core having a positive hemisphere and a negative hemisphere and being rotatable such that a north pole of the positive hemisphere and a south pole of the negative hemisphere can be horizontally oriented within the pair of ferrous blocks in an engaged position or alternatively vertically oriented within the non-ferrous median in an alternate disengaged position, the magnetic core thus magnetizing the pair of ferrous blocks in the engaged position and alternatively demagnetizing the pair of ferrous blocks in the alternate disengaged position;

a magnet rod coupled to the magnetic core, the magnet rod extending through a rod aperture of the front side of the magnet housing; and a handle coupled to the magnet rod, the handle being used to rotate the magnet rod and thus the magnetic core from the engaged position to the alternate disengaged position.

2. The magnetic vise base apparatus of claim 1 further comprising the top side being pitched and having a flat central section and a pair of angled side sections, the front side and the rear side thus being hexagonal.

3. The magnetic vise base apparatus of claim 1 further comprising a flat central section being parallel to, and spaced from, the underside of the top platform and configured to give clearance for the pair of fasteners.

4. The magnetic vise base apparatus of claim 1 further comprising a left edge and a right edge of the top platform extending past the pair of side walls.

5. The magnetic vise base apparatus of claim 1 further comprising a width of the non-ferrous median being less than 30% of a width of the inner cavity between the left side and the right side.

6. The magnetic vise base apparatus of claim 1 further comprising each of the left side and the right side having an outer bridge portion, the outer bridge portion being coupled to the pair of side walls and having a height less than an overall height of the right side and the left side.

7. The magnetic vise base apparatus of claim 1 further comprising the magnet having a lower channel defined along a bottom face of the non-ferrous median between the pair of ferrous blocks.

8. The magnetic vise base apparatus of claim 1 further comprising the handle having a cylindrical hub coupled around the magnet rod and a handle arm perpendicularly extending from the cylindrical hub.

9. The magnetic vise base apparatus of claim 8 further comprising the handle having a grip coupled to the handle arm proximal a distal end thereof.

10. The magnetic vise base apparatus of claim 8 further comprising a pair of stop rods perpendicularly coupled to the front side of the magnet housing, the pair of stop rods limiting a range of motion of the handle arm.

11. The magnetic vise base apparatus of claim 10 further comprising the pair of stop rods being separated by 90° relative a central axis of the magnet core and the magnet rod.

12. A magnetic vise base apparatus comprising:

a base, the base having a top platform and a pair of side walls perpendicularly coupled to an underside of the top platform, a left edge and a right edge of the top platform extending past the pair of side walls, the top platform having a pair of threaded mounting holes extending from a topside through the underside proximal a front edge and a rear edge, the pair of threaded mounting holes being configured to receive a pair of fasteners to fix a vise to the top platform;

a magnet housing coupled to the base, the magnet housing having a front side separated from a rear side, a top side separated from an open bottom side, and a right side separated from a left side forming an inner cavity, the left side and the right side being coupled to an inner face of the pair of side walls and extending from proximal the front edge to proximal the rear edge of the top platform, each of the left side and the right side having an outer bridge portion coupled to the pair of side walls and having a height less than an overall height of the right side and the left side, the top side being pitched and having a flat central section and a pair of angled side sections, the flat central section being parallel to, and spaced from, the underside of the top platform and configured to give clearance for the pair of fasteners, the front side and the rear side thus being hexagonal;

a magnet coupled to the magnet housing, the magnet comprising:

a pair of ferrous blocks, the pair of ferrous blocks coupled to the left side and the right side and extending from the front side to the rear side and from the top side to the open bottom side within the inner cavity;

a non-ferrous median coupled to the pair of ferrous blocks, the non-ferrous median extending from the front side to the rear side and from the top side to proximal the open bottom side within the inner cavity between the pair of ferrous blocks, a width of the non-ferrous median being less than 30% of a width of the inner cavity between the left side and the right side, the magnet having a lower channel defined along a bottom face of the non-ferrous median between the pair of ferrous blocks;

the magnet having a core aperture extending from the front side to the rear side fully through the non-ferrous median and partially into each of the pair of ferrous blocks;

a magnetic core coupled within the core aperture, the magnetic core extending from the front side to the rear side, the magnetic core having a positive hemisphere and a negative hemisphere and being rotatable such that a north pole of the positive hemisphere and a south pole of the negative hemisphere can be horizontally oriented within the pair of ferrous blocks in an engaged position or alternatively vertically oriented within the non-ferrous median in an alternate disengaged position, the magnetic core thus magnetizing the pair of ferrous blocks in the engaged position and alternatively demagnetizing the pair of ferrous blocks in the alternate disengaged position;

a magnet rod coupled to the magnetic core, the magnet rod extending through a rod aperture of the front side of the magnet housing;

a handle coupled to the magnet rod, the handle being used to rotate the magnet rod and thus the magnetic core from the engaged position to the alternate disengaged position, the handle having a cylindrical hub coupled around the magnet rod and a handle arm perpendicularly extending from the cylindrical hub, the handle having a grip coupled to the handle arm proximal a distal end thereof; and a pair of stop rods perpendicularly coupled to the front side of the magnet housing, the pair of stop rods limiting a range of motion of the handle arm, the pair of stop rods being separated by 90° relative a central axis of the magnet core and the magnet rod.

13. A vise and magnetic vise base apparatus combination comprising:

a vise;

a base, the base having a top platform and a pair of side walls perpendicularly coupled to an underside of the top platform, a left edge and a right edge of the top platform extending past the pair of side walls, the top platform having a pair of threaded mounting holes extending from a topside through the underside proximal a front edge and a rear edge, the pair of threaded mounting holes receiving a pair of fasteners to fix the vise to the top platform;

a magnet housing coupled to the base, the magnet housing having a front side separated from a rear side, a top side separated from an open bottom side, and a right side separated from a left side forming an inner cavity, the left side and the right side being coupled to an inner face of the pair of side walls and extending from proximal the front edge to proximal the rear edge of the top platform, each of the left side and the right side having an outer bridge portion coupled to the pair of side walls and having a height less than an overall height of the right side and the left side, the top side being pitched and having a flat central section and a pair of angled side sections, the flat central section being parallel to, and spaced from, the underside of the top platform to give clearance for the pair of fasteners, the front side and the rear side thus being hexagonal;

a magnet coupled to the magnet housing, the magnet comprising:

a pair of ferrous blocks, the pair of ferrous blocks coupled to the left side and the right side and extending from the front side to the rear side and from the top side to the open bottom side within the inner cavity;

a non-ferrous median coupled to the pair of ferrous blocks, the non-ferrous median extending from the front side to the rear side and from the top side to proximal the open bottom side within the inner cavity between the pair of ferrous blocks, a width of the non-ferrous median being less than 30% of a width of the inner cavity between the left side and the right side, the magnet having a lower channel defined along a bottom face of the non-ferrous median between the pair of ferrous blocks;

the magnet having a core aperture extending from the front side to the rear side fully through the non-ferrous median and partially into each of the pair of ferrous blocks;

a magnetic core coupled within the core aperture, the magnetic core extending from the front side to the rear side, the magnetic core having a positive hemisphere and a negative hemisphere and being rotatable such that a north pole of the positive hemisphere and a south pole of the negative hemisphere can be horizontally oriented within the pair of ferrous blocks in an engaged position or alternatively vertically oriented within the non-ferrous median in an alternate disengaged position, the magnetic core thus magnetizing the pair of ferrous blocks in the engaged position and alternatively demagnetizing the pair of ferrous blocks in the alternate disengaged position;

a magnet rod coupled to the magnetic core, the magnet rod extending through a rod aperture of the front side of the magnet housing;

a handle coupled to the magnet rod, the handle being used to rotate the magnet rod and thus the magnetic core from the engaged position to the alternate disengaged position, the handle having a cylindrical hub coupled around the magnet rod and a handle arm perpendicularly extending from the cylindrical hub, the handle having a grip coupled to the handle arm proximal a distal end thereof; and a pair of stop rods perpendicularly coupled to the front side of the magnet housing, the pair of stop rods limiting a range of motion of the handle arm, the pair of stop rods being separated by 90° relative a central axis of the magnet core and the magnet rod.

* * * * *